US007978566B1

(12) United States Patent
Russo

(10) Patent No.: US 7,978,566 B1
(45) Date of Patent: Jul. 12, 2011

(54) TIMING APPARATUS FOR ALERTING A USER WHEN TIME HAS ELAPSED

(76) Inventor: Christopher Russo, Westbury, NY (US)

( * ) Notice: Subject to any disclaimer, the term of this patent is extended or adjusted under 35 U.S.C. 154(b) by 11 days.

(21) Appl. No.: 12/454,919

(22) Filed: May 26, 2009

(51) Int. Cl.
*G04C 17/00* (2006.01)
*G04F 10/00* (2006.01)

(52) U.S. Cl. ..... 368/241; 368/108

(58) Field of Classification Search ..... 368/89, 368/107–109, 223, 239–242
See application file for complete search history.

(56) References Cited

U.S. PATENT DOCUMENTS

| | | | | | |
|---|---|---|---|---|---|
| 2,243,343 | A | * | 5/1941 | Johnson | 368/222 |
| 3,200,218 | A | * | 8/1965 | Wagner | 340/929 |
| 3,320,585 | A | * | 5/1967 | Hines | 340/929 |
| 3,574,992 | A | * | 4/1971 | Ladas | 368/82 |
| 3,587,222 | A | * | 6/1971 | Mestrovic | 368/78 |
| 3,852,949 | A | * | 12/1974 | Sayler | 368/76 |
| 3,854,279 | A | * | 12/1974 | Edmunds | 368/82 |
| 4,070,819 | A | * | 1/1978 | Kelly | 368/76 |
| 4,130,987 | A | * | 12/1978 | Schickedanz | 368/29 |
| 4,161,098 | A | * | 7/1979 | Ingendahl | 368/76 |
| 4,167,001 | A | * | 9/1979 | Gilmore | 340/929 |
| D275,938 | S | * | 10/1984 | Sonier | D11/131 |
| 4,995,018 | A | * | 2/1991 | Edwards | 368/107 |
| 5,044,961 | A | | 9/1991 | Bruskewitz | |
| 5,228,013 | A | * | 7/1993 | Bik | 368/223 |
| 5,253,228 | A | * | 10/1993 | Truett | 368/82 |
| 5,299,178 | A | | 3/1994 | Belik | |
| 5,325,340 | A | * | 6/1994 | Ramsey | 368/3 |
| 5,365,495 | A | * | 11/1994 | Cussen | 368/79 |
| 5,683,137 | A | | 11/1997 | McDonald et al. | |
| 5,896,348 | A | * | 4/1999 | Lyon | 368/223 |
| 6,256,265 | B1 | * | 7/2001 | Sepulveda | 368/82 |
| 6,326,883 | B1 | * | 12/2001 | Whitehead et al. | 340/309.8 |
| 6,416,216 | B1 | | 7/2002 | Haughey | |
| 6,478,583 | B1 | | 11/2002 | Standiford et al. | |
| 7,388,813 | B2 | * | 6/2008 | Su | 368/79 |
| D595,594 | S | * | 7/2009 | Garcia | D10/1 |
| 7,616,528 | B2 | * | 11/2009 | Meadows | 368/76 |
| 7,729,206 | B2 | * | 6/2010 | Gordon et al. | 368/109 |
| 7,835,231 | B1 | * | 11/2010 | Garcia | 368/223 |
| 2006/0133215 | A1 | * | 6/2006 | Gordon et al. | 368/79 |
| 2007/0171770 | A1 | * | 7/2007 | Thompson et al. | 368/82 |
| 2008/0175106 | A1 | * | 7/2008 | Vikesland | 368/83 |

* cited by examiner

*Primary Examiner* — Sean Kayes
(74) *Attorney, Agent, or Firm* — Richard L. Miller

(57) ABSTRACT

A timing apparatus for alerting a user when time has elapsed which comprises a base. A post extends vertically and centrally from the base. A mechanism extends through the base and the post, for indicating when a set time has elapsed.

6 Claims, 3 Drawing Sheets

TIMING APPARATUS FOR ALERTING A USER WHEN TIME HAS ELAPSED

BACKGROUND OF THE INVENTION

1. Field of the Invention

The present invention relates to a timer, and more particularly, a timing apparatus for alerting a user when time has elapsed.

2. Description of the Prior Art

Numerous innovations for child activity timing devices have been provided in the prior art that will be described. Even though these innovations may be suitable for the specific individual purposes to which they address, however, they differ from the present invention.

A FIRST EXAMPLE, U.S. Patent Office Document No. 5,044,961, Issued on Sep. 3, 1991, to Bruskewitz teaches a timer for teaching young children the concept of time is described. The timer includes a timing mechanism contained within a housing having a timer dial and activity selector. The timer dial permits selection of a duration of predetermined length and includes an indicator which moves in relation to a time scale to graphically illustrate the change in duration of length. The activity selector permits display of a graphic representation of the activity being timed or for which the child is waiting.

A SECOND EXAMPLE, U.S. Patent Office Document No. 5,299,178, Issued on Mar. 29, 1994, to Belik teaches a clock having a motor with a shaft extending outwardly therefrom, a sprocket affixed to the shaft, a clock dial positioned adjacent the sprocket and having minute indica displayed thereon, a plurality of hour members being interconnected together in the form of a continuous band, and a minute hand interconnected to the sprocket such that the minute hand moves in relation to the movement of the sprocket. The continuous band extends over a portion of the sprocket such that the plurality of hour members move relative to a movement of the sprocket. The sprocket is a geared member having a plurality of teeth extending outwardly therefrom for the purpose of engaging a portion of the continuous band. Each of the plurality of hour members is equally spaced from an adjacent hour member. Each of the plurality of hour members is connected by a chain section to an adjacent hour member. The sprocket engages the chain section between the hour members.

A THIRD EXAMPLE, U.S. Patent Office Document No. 5,683,137, Issued on Nov. 4, 1997, to McDonald et al. teaches a time-out seat for a child which comprises a seat member configured and dimensioned to accept a child in a sitting position; a structure which supports the seat member in an orientation for sitting and at a predetermined height. A timer is provided for timing a preset time-out period. The timer includes the capabilities of setting a predetermined time-out period, indicating the time remaining in the time-out period, and signaling the end of the time-out period. The timer is supported in a position where a child sitting in the seat can observe the indication of the time remaining in the time-out period. A method of disciplining a child using the time-out seat is also contemplated by the present invention.

A FOURTH EXAMPLE, U.S. Patent Office Document No. 6,416,216 B1, Issued on Jul. 9, 2002, to Haughey teaches a convenient, effective, and interactive system to aid children or others in managing and understanding the concept of time and in remembering scheduled events. The present event clock visually demonstrates the time during which at least one predetermined event is scheduled to occur. Generally, the event clock includes a timing mechanism, an indicator operatively connected to the timing mechanism, and at least one (and preferably several) event marker(s). Each event marker visually symbolizes (through pictures, words, or otherwise) a scheduled event and is disposed in relation to the indicator such that the indicator provides a signal during the time the event is scheduled to occur.

A FIFTH EXAMPLE, U.S. Patent Office Document No. 6,478,583 B1, Issued on Nov. 12, 2002, to Standiford et al. teaches a child educational entertainment device including a housing with a display mounted thereon. Further included is a control mechanism positioned within the housing and adapted to be prompt a user to enter an amount of time. Once the time has been entered, a decrementing timer is displayed to count down from the entered amount of time. The control mechanism has at least one mode wherein it is adapted to graphically display the decrementing timer. Further, additional modes are included for entertainment purposes.

It is apparent now that numerous innovations for child activity timing devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a timing apparatus for alerting a user when time has elapsed that avoids the disadvantages of the prior art.

ANOTHER OBJECT of the present invention is to provide a timing apparatus for alerting a user when time has elapsed that is simple and inexpensive to manufacture.

STILL ANOTHER OBJECT of the present invention is to provide a timing apparatus for alerting a user when time has elapsed that is simple to use.

BRIEFLY STATED, STILL YET ANOTHER OBJECT of the present invention is to provide a timing apparatus for alerting a user when time has elapsed which comprises a base. A post extends vertically and centrally from the base. A mechanism extends through the base and the post for indicating when a set time has elapsed.

The novel features which are considered characteristic of the present invention are set forth in the appended claims.

The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

10 timing apparatus

12 user

14 base of timing apparatus 10
16 post of timing apparatus 10
18 time indicating mechanism of timing apparatus 10
20 electrical circuit of time indicating mechanism 18
22 on/off switch of time indicating mechanism 18
24 battery of time indicating mechanism 18
26 timer of time indicating mechanism 18
28 button of time indicating mechanism 18
30 display screen of time indicating mechanism 18
32 light emitting diode of time indicating mechanism 18
34 switching element of time indicating mechanism 18
36 audio generator of time indicating mechanism 18
38 speaker of time indicating mechanism 18
40 diagonal color ring on post 16
42 relay switch for switching element 34
44 switching transistor for switching element 34
46 silicone controlled rectifier for switching element 34

DETAILED DESCRIPTION OF THE PREFERRED EMBODIMENT

Figure 1:
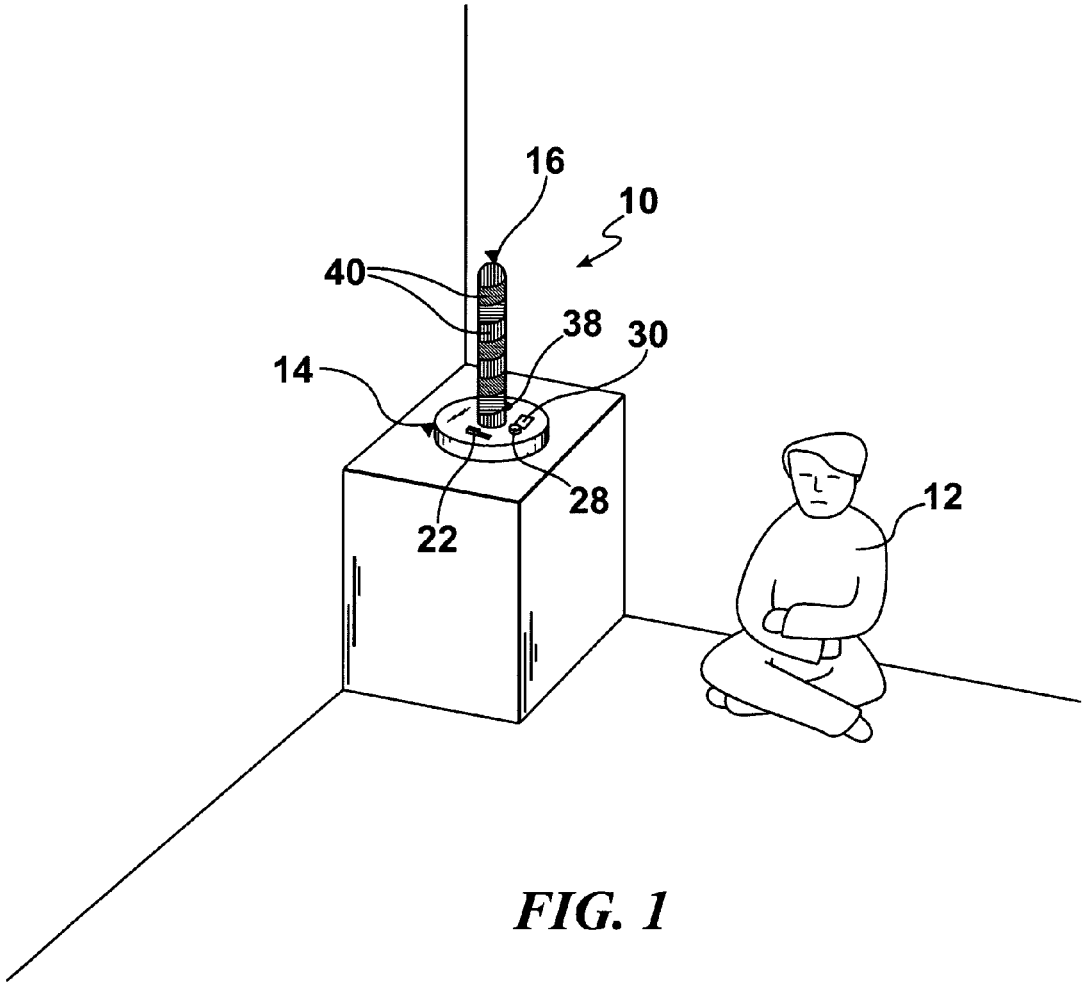
FIG. 1 is a diagrammatic perspective view of an embodiment of the present invention in use.
Figure 2:
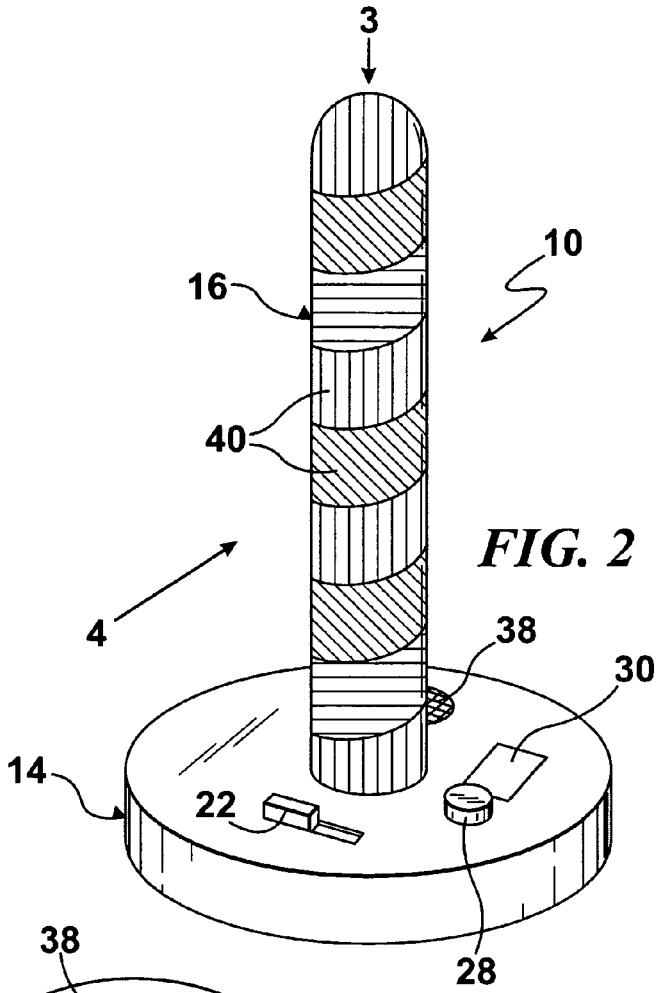
FIG. 2 is an enlarged diagrammatic perspective view of the present invention per se.
Figure 3:
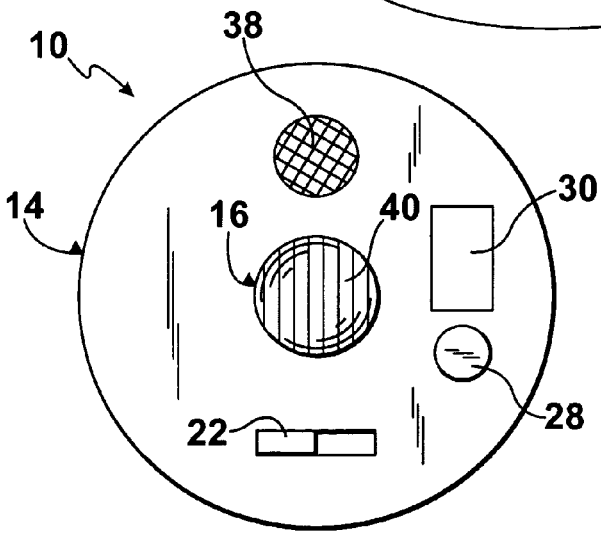
FIG. 3 is a diagrammatic top plan view taken in the direction of arrow 3 in FIG. 2.
Figure 4:
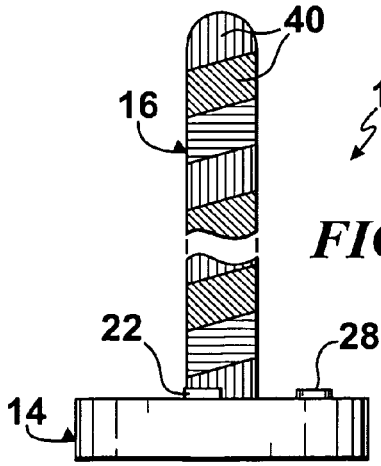
FIG. 4 is a diagrammatic side elevational view taken in the direction of arrow 4 in FIG. 2, with parts broken away.
Figure 5:
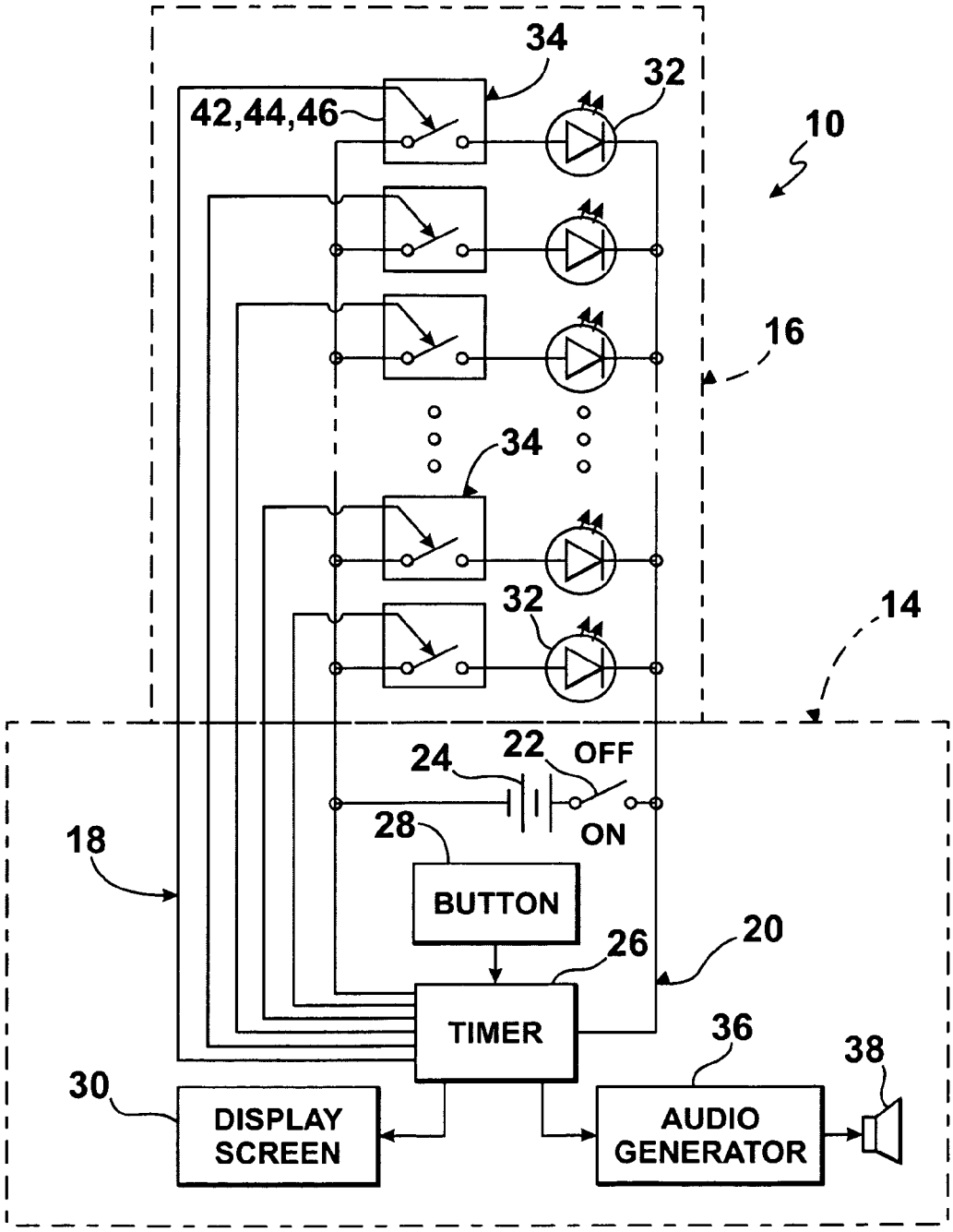
FIG. 5 is a block diagram of the electrical circuit thereof.

Referring now to the figures, in which like numerals indicate like parts, and particularly to FIGS. 1 through 5, which are a diagrammatic perspective view of an embodiment of the present invention in use; an enlarged diagrammatic perspective view of the present invention per se; a diagrammatic top plan view taken in the direction of arrow 3 in FIG. 2; a diagrammatic side elevational view taken in the direction of arrow 4 in FIG. 2, with parts broken away; and a block diagram of the electrical circuit thereof, and as such, will be discussed with reference thereto.

The present invention is a timing apparatus 10 for alerting a user 12 (such as a child) when time has elapsed which comprises a base 14. A post 16 extends vertically and centrally from the base 14. A mechanism extends through the base 14 and the post 16, for indicating when a set time has elapsed.

The time indicating mechanism 18 comprises an electrical circuit 20. An on/off switch 22 on the base 14 is electrically connected to the electrical circuit 20. A battery 24 in the base 14 is electrically connected between the on/off switch 22 and the electrical circuit 20. A timer 26 in the base 14 is electrically connected to the electrical circuit 20. A button 28 on the base 14 is manually connected to the timer 26, to set a time interval for the timer 26. A display screen 30 on the base 14 is electrically connected to the timer 26, to indicate the time interval set. A plurality of light emitting diodes 32 are visually seen through the post 16 and are electrically connected in the electrical circuit 20 to the timer 26. A plurality of switching elements 34 are in the post 16. Each switching element 34 is electrically connected between one light emitting diode 32 and the timer 26. The user 12 may visually see each light emitting diode 32 light up along the post 16 during the time set interval.

The time indicating mechanism 18 further comprises an audio generator 36 in the base 14 electrically connected to the timer 26. A speaker 38 in the base 14 is electrically connected to the audio generator 36, whereby the user 12 may audibly hear when the set time has elapsed.

The post 16 further comprises a plurality of diagonal color rings 40 thereabout. When each light emitting diode 32 lights up, a different color will be visually seen by the user 12 through one diagonal color ring 40. In the timing apparatus 10, each switching element 34 can consist of a relay switch 42, a switching transistor 44 or a silicone controlled rectifier 46.

The timing apparatus 10 can help children and parents during time out. When the parent places a child in time out the child doesn't understand time. The colors of the post 16 will light up and change as they climb the post 16 predicated upon the time set. The timing apparatus 10 will buzz or announce when time out is over. The timing apparatus 10 can be set in thirty second intervals. One minute per age, example for a two year old two minutes. Every time you click the button 28 it adds thirty seconds to the timer 26. This will make time out easier for mom and dad and will help teach the child a lesson.

It will be understood that each of the elements described above, or two or more together, may also find a useful application in other types of constructions differing from the types described above.

While the invention has been illustrated and described as embodiments of a timing apparatus for alerting a user when time has elapsed, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A timing apparatus for alerting a user when time has elapsed which comprises:

a) a base;
b) a post extending vertically and centrally from said base; and
c) means, extending through said base and said post, for indicating when a set time has elapsed;

wherein said time indicating means comprises;

a) an electrical circuit;
b) an on/off switch on said base, electrically connected to said electrical circuit;
c) a battery in said base, electrically connected between said on/off switch and said electrical circuit;
d) a timer in said base, electrically connected to said electrical circuit;
e) a button on said base, manually connected to said timer, to set a time interval for said timer;
f) a display screen on said base, electrically connected to said timer, to indicate the time interval set;
g) a plurality of light emitting diodes visually seen through said post and electrically connected in said electrical circuit to said timer; and
h) a plurality of switching elements in said post, wherein each said switching element is electrically connected between one said light emitting diode and said timer, whereby the user may visually see each said light emitting diode light up along said post during the time set interval;

wherein said post further comprises a plurality of diagonal color rings thereabout, wherein when each said light emitting diode lights up, a different color will be visually seen by the user through one said diagonal color ring.

2. The timing apparatus, as recited in claim 1, wherein said time indicating means further comprises:

a) an audio generator in said base electrically connected to said timer; and b) a speaker in said base electrically connected to said audio generator, whereby the user may audibly hear when the set time has elapsed.

3. The timing apparatus as recited in claim 1, wherein each said switching element comprises a relay switch.

4. The timing apparatus, as recited in claim 1, wherein each said switching element comprises a switching transistor.

5. The timing apparatus, as recited in claim 1, wherein each said switching element comprises a silicone controlled rectifier.

6. A timing apparatus for alerting a user when time has elapsed which comprises:

a) a base;

b) a post extending vertically and centrally from said base; and c) means, extending through said base and said post, for indicating when a set time has elapsed; wherein said time indicating means comprises;

d) an electrical circuit;

e) an on/off switch on said base, electrically connected to said electrical circuit;

f) a battery in said base, electrically connected between said on/off switch and said electrical circuit;

g) a timer in said base, electrically connected to said electrical circuit;

h) a button on said base, manually connected to said timer, to set a time interval for said timer;

I) a display screen on said base, electrically connected to said timer, to indicate the time interval set;

j) a plurality of light emitting diodes visually seen through said post and electrically connected in said electrical circuit to said timer; and k) a plurality of switching elements in said post, wherein each said switching element is electrically connected between one said light emitting diode and said timer, whereby the user may visually see each said light emitting diode light up along said post during the time set interval; wherein said time indicating means further comprises:

l) an audio generator in said base electrically connected to said timer; and m) a speaker in said base electrically connected to said audio generator, whereby the user may audibly hear when the set time has elapsed; wherein said post further comprises a plurality of diagonal color rings thereabout, wherein when each said light emitting diode lights up, a different color will be visually seen by the user through one said diagonal color ring; wherein each said switching element is selected from the group consisting of a relay switch, a switching transistor and a silicone controlled rectifier.

* * * * *